United States Patent [19]

Stein

[11] Patent Number: 4,470,518

[45] Date of Patent: Sep. 11, 1984

[54] SECURITY BOX HAVING A SLIDING LID

[75] Inventor: Eric D. Stein, Cincinnati, Ohio

[73] Assignee: Buckhorn Material Handling Group Inc., Cincinnati, Ohio

[21] Appl. No.: 533,586

[22] Filed: Sep. 19, 1983

Related U.S. Application Data

[63] Continuation-in-part of Ser. No. 317,757, Nov. 3, 1981, Pat. No. 4,405,057.

[51] Int. Cl.[3] ..... B65D 43/20

[52] U.S. Cl. ..... 220/346; 220/210; 206/508; 109/45; 109/49

[58] Field of Search ..... 220/210, 214, 345, 346; 109/45, 49; 206/508, 509

[56] References Cited

U.S. PATENT DOCUMENTS

| | | | |
|---|---|---|---|
| 926,537 | 6/1909 | Bagley | 220/346 |
| 3,979,016 | 9/1976 | Frater | 206/508 |

*Primary Examiner*—George T. Hall

*Attorney, Agent, or Firm*—Beall Law Offices

[57] ABSTRACT

A security box for storing, transporting, and selectively viewing papers is disclosed. Interfitting locking structure is provided between the lid and container. Pockets having interior and exterior portions are provided in the side and end walls. The interior portion of the pockets supports opposite ends of dividers, and the exterior of the pockets comprise nesting stops for containers stacked in a nested stack without lids.

12 Claims, 14 Drawing Figures

SECURITY BOX HAVING A SLIDING LID

RELATED APPLICATION

This is a continuation-in-part of application Ser. No. 317,757 filled Nov. 3, 1981., now U.S. Pat. No. 4,405,057.

BACKGROUND OF THE INVENTION

There is a need to store, transport, and selectively view papers having information on them. This need has been in part satisfied by various small portable boxes that usually have disadvantages relating to their strength, short life, inability to properly hold a small number of papers and high expense in view of their short life. These boxes are usually made from paper. Metal file cabinets that are well know in offices overcome the diffficulties mentioned above, but are too heavy for usual transport. Also file cabinets are expensive, and at least with respect to the lower drawers, difficult to work with when it is desired to view the documents.

Many various general purpose containers are known, but in general they are unsuitable for the above mentioned usage.

SUMMARY OF THE INVENTION

It is an object of the present invention to provide a box that may adequately transport, store, and provide viewing of papers or documents, such as checks, which are generally of a similar size and shape. Paticularly this is done in a secure fashion wherein a lid and lock may be provided, and cheaply wherein molded synthetic resin is used as the primary material. The boxes are light weight and small so that they may be easily handled for moving them form one office to another, for placement upon a desk for easy viewing of the documents contained therein, and for moving them into and out of storage.

Security for the boxes is provided by a lid that interlocks with the container and is prevented from being removed by a lock, such as aligned apertures in the lid and container that may pass there through a security tie or padlock, or the like.

BRIEF DESCRIPTION OF THE DRAWINGS

Further object, features and advantages of the present invention will become more clear from the following detailed description of the preferred embodiment shown in the accompanying drawings, wherein.

DETAILED DESCRIPTION OF A PREFERRED EMBODIMENT

Figure 9:
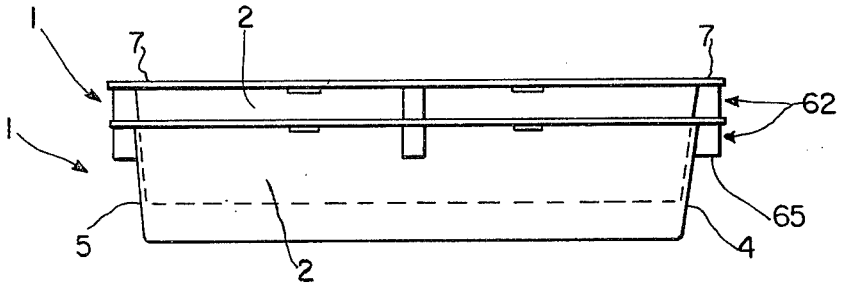
FIG. 9 is an end view of one end of two containers, without lids, that are stacked together.
Figure 10:
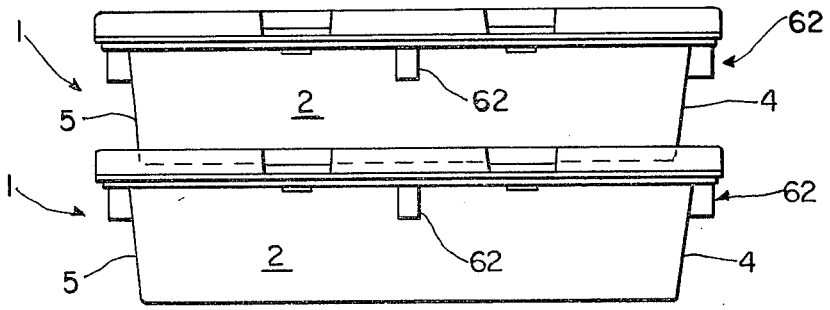
FIG. 10, is an end view corresponding to FIG. 9, but with lids being provided for each of the containers.

A preferred embodiment will be described in detail and is shown in the drawings for purpose of illustration of the broader principles of the present invention and further for showing details that are specific features of the present invention. Like numerals are shown throughout the various figures to indicate like structure. In FIG. 9, two containers 1 are stacked one upon the other with the upper container being nested within the lower container. Such a nested stack is suitable for storing the containers without their lids when the containers are generally empty. In FIG. 10, the same containers are shown in a similar position, but each is now provided with a lid 12. The lids are of identical structure.

Each container is provided with opposite end walls 2 and 3, and opposite side walls 4 and 5, which are integrally joined in one piece with each other to form a continuous rectangular upwardly extending wall, and which in turn are integrally joined in one piece with a bottom wall 6. The container is preferrably molded in one piece from a synthetic resin, for example polypropylene. The end walls and side walls are generally vertical, although they have a small taper, for example, of seven degrees for reasons to be hearinafter explained. Their lower most edges are entirely connected to the entire periphery of the rectangular bottom wall 6. The upwardly extending edges of the side and end walls are entirely connected in one piece with their adjacent walls.

The upper edge portions of the side walls 4, 5 and end walls 2, 3 include outwardly extending horizontal flanges 7, as can be seen in FIG. 9 connected together around substantially the entire upper periphery of the container to constitute side flanges 8, 9 and end flanges 10, 11. In addition to an upper flange 8, is lower flange 16; similarly, in addition to upper flange 9, is a lower flange identical to lower flange 16 on the opposite side of the container 17. The side flanges taper downwardly at one end of the container to form end flange 10. End flange 11 also does not have an additional lower flange. As can be best seen in FIG. 11, a flange connecting side wall 40 connects upper and lower horizontal flanges 9 and 17. Similar structure is provided for between upper and lower flanges 8 and 16.

The lid 12 is preferably molded in one piece from a synthetic resin, for example polyester. The lid is of rectangular shape and a size to close the open top of the container 1, with the peripheral edge portion of the lid being rectangular and having a flange 13 overlying the flange 7 of the container.

Figure 1:
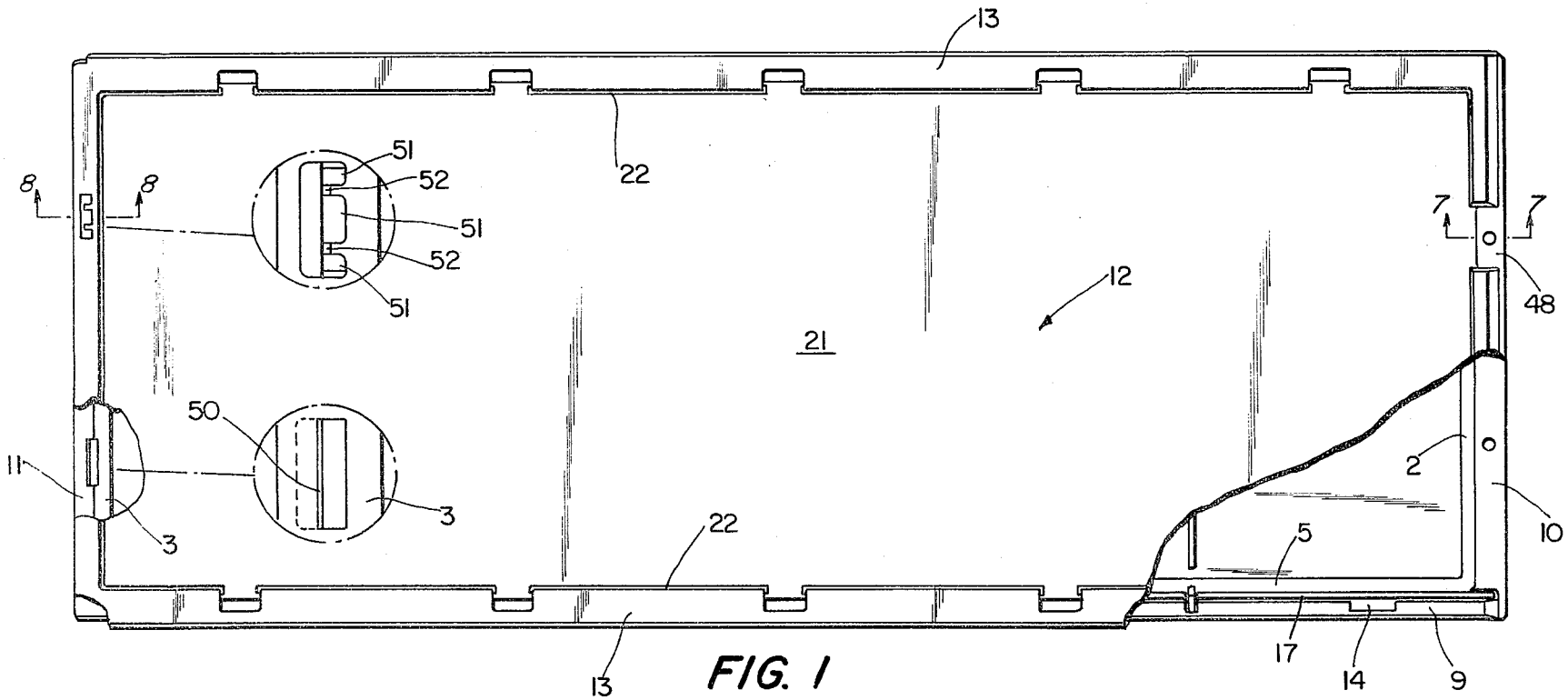
FIG. 1 is a top plan view of the container and lid, with portions broken away to illustrate structure and certain structure enlarged to show detail.
Figure 2:
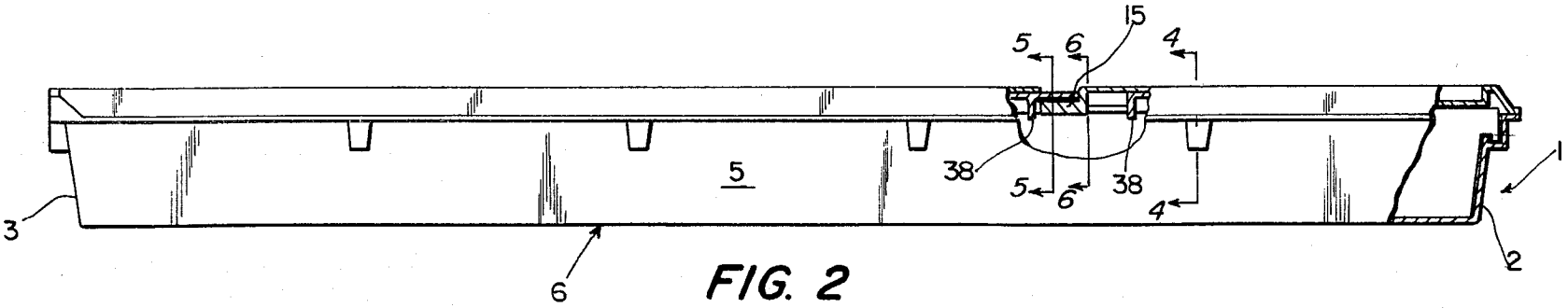
FIG. 2 is a side elevation view of the container and lid, with portions broken away to illustrate structure.
Figure 3:
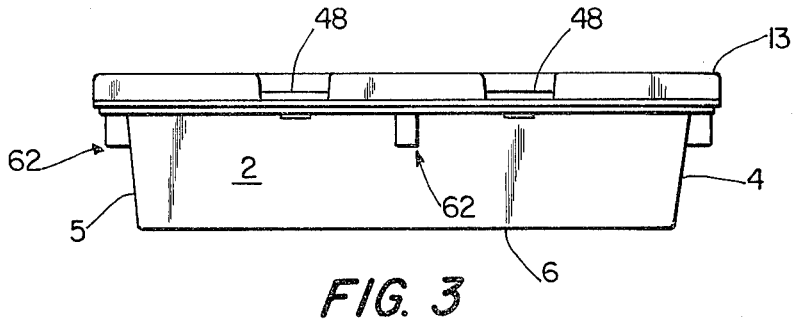
FIG. 3 is one end view of the container and lid.
Figure 11:
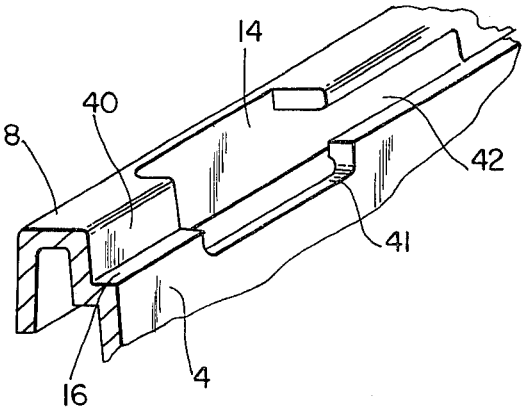
FIG. 11 is a perspective view of one of the sides of the container, illustrating specific structure.
Figure 12:
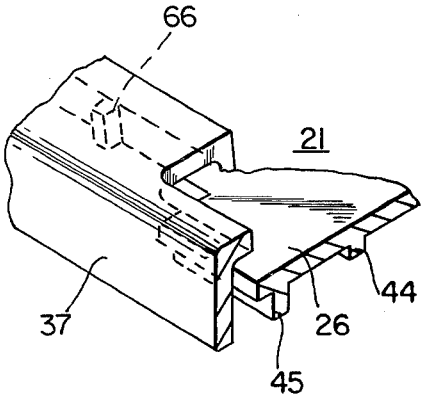
FIG. 12 is perspective view of the peripheral flange of the lid and is similar to the lid structure shown in FIG. 5.
Figure 13:
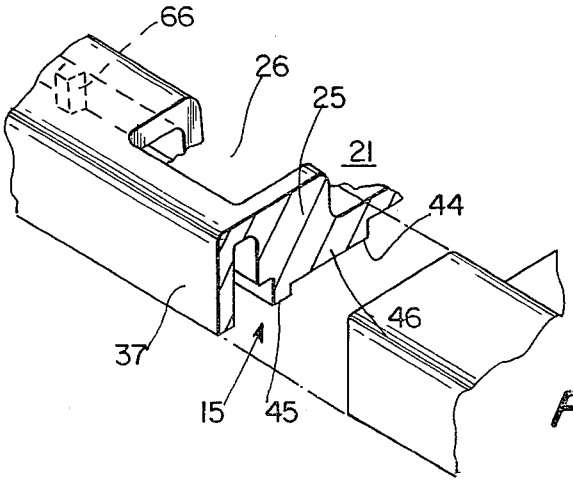
FIG. 13 is a perspective view of the peripheral flange of the lid, with portions broken away to illustrate structure, and is similar to the lid structure shown in FIG. 6.
Figure 14:
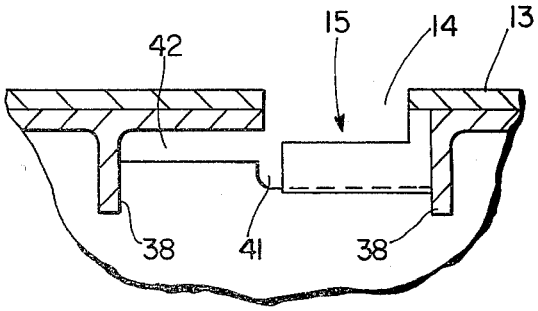
FIG. 14 is a side elevational view similar to a portion broken away in FIG. 2, but showing the lid and container in a different relative position.

The lid 12 is interlockingly assembled onto its container. For this purpose, the flange 7 of the container is provided with a plurality of through apertures 14, only one of which can be seen in FIG. 1. Preferably, five through apertures 14 are provided on each of the side flanges 8, 9. In addition to the through apertures, as can be seen in FIG. 11, a recess 41 is provided that is cut out of side wall 4 directly vertically below through aperture 14. Also, a flange connecting side wall cut out portion 42 can be seen. The lid is integrally formed with a plurality of depending side flange engaging hooks 15 as can be seen in FIGS. 2, 12 and 13. Hooks 15 are molded in one piece with the lid and are positioned such that they are in general alignment with and extend through the apertures 14 when the lid is assembled on the container. Each hook is provided with a downwardly extending shaft portion 25 and horizontally extending return portion 26 that in the position of FIG. 2 underlies the container flange 7. For assembly of the lid, the lid is placed above the container with the hooks 15 aligned with the apertures 14, and thereafter the lid is moved downwardly so that the hooks 15 will extend through the apertures 14 as shown in FIG. 14. Thereafter the lid is translated horizontally relative to the container and parallel to the container side walls toward the container end wall 3, so that the hooks will assume the locked position shown in FIG. 2. In FIG. 14, a closed position is shown wherein the lid actually closes the container although it is not locked. When the lid is moved vertically upward from the position of FIG. 14 to completely disengage the lid from the container, any such positions are refered to as a disengaged position.

The lid further includes a flat planar horizontal major mid-portion that is rectangular. This mid-portion 21 is horizontally inset and vertically recessed from the lid flange 13 and joined to the lid flange 13 by means of continuous vertical wall 22 forming opposite side and end walls for the lid.

Figure 4:
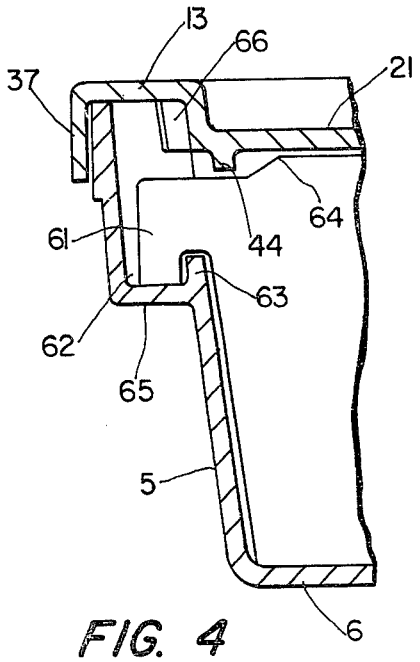
FIG. 4 is a cross-sectional view taken along line 4—4 of FIG. 2.
Figure 5:
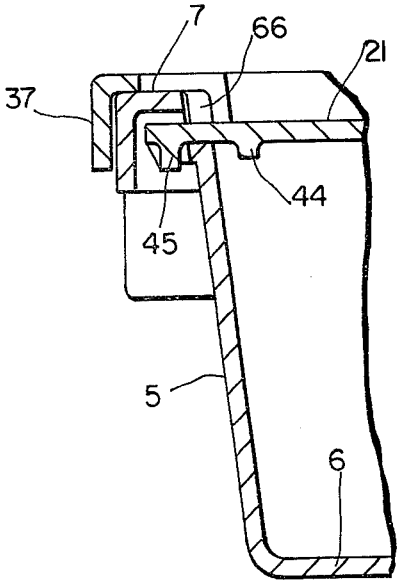
FIG. 5 is a cross-sectional view taken along line 5—5 of FIG. 2.
Figure 6:
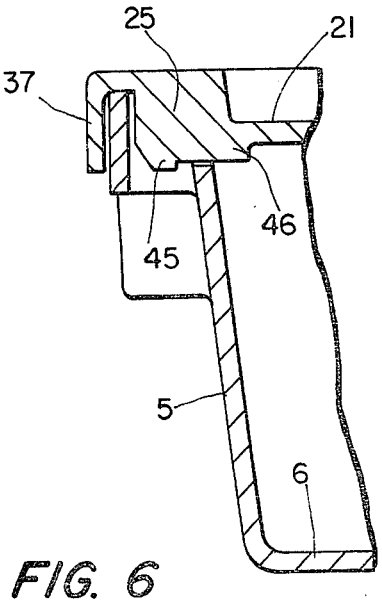
FIG. 6 is a cross-sectional view taken along line 6—6 of FIG. 2.

Various structure is provided to strengthen the container and the lid. A first downwardly extending rib 44, as best seen in FIGS. 4 and 12 extends around the entire periphery of the lid mid-portion 21 for stiffening. Each hook portion has an additional second downwardly extending rib 45, parallel to rib 44 as best seen in FIG. 12. Rib 45 extends along return portion 26. A third inwardly extending rib 46, as can be seen in FIGS. 6 and 13, extends transversely between ribs 44 and 45 at the end of return portion 26 that is adjacent shaft portion 25. Rib 46 extends downwardly into a downwardly extending recessed portion 41 when the lid is assembled onto the container. As the lid is moved horizontally toward end wall 3, rib 45 and rib 44 extend respectively to the outside and inside of the respective lower horizontal flanges 16 and 17. Outside rib 45 prevents the side wall from being flexed outwardly while inside rib 44 prevents the side wall from being flexed inwardly while additionally giving support to the lid recess mid-portion. Rib 46 provides additional reinforcement for ribs 44 and 45. Rib 46 also engages the uppermost edge of the container side wall, which forms the bottom of recessed portion 41.

For the container, an additional vertical flange 37 extends around the periphery of the container with the exception of end wall 2. A plurality of webs 38 are integrally joined to and extend between flanges 37 and horizontal flanges 8, 9, and 11. As can be seen in FIG. 2, the through apertures 14 extend between webs 38.

Figure 7:
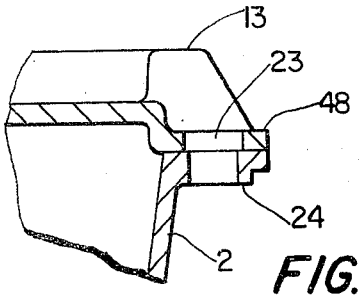
FIG. 7 is a cross-sectional view taken along line 7—7 of FIG. 1.

When in the locked position of FIG. 2, a number of different structures may be employed to lock or securely retain the lid to prevent its movement from the locked position to the closed position of FIG. 14. One such structure that may be used is shown in FIG. 7. An aperture 23 extends through a lower horizontal flange portion 48, which is integrally molded along lid flange 13. An aperture 24 in the flange 7 of container 1 is aligned vertically below aperture 23 when the lid is in the locked position. Preferrably, two lower horizontal flange portions and corresponding apertures are provided for on the lid and two corresponding apertures provided for along horizontal flange 7 of the container. A simple security tie not shown such as a rope, piece of wire, plastic loop fastener or the like may be passed through the aligned apertures 23 and 24 and secured. Some such fasteners can only be disassembled by destroying them, which would indicate that the contents of the box may have been tampered with. For more security the shackle of a conventional padlock (not shown) could be passed through apertures 23, 24.

Figure 8:
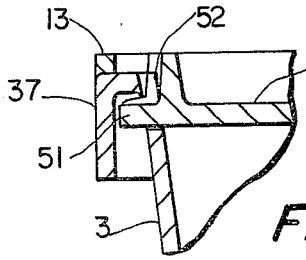
FIG. 8 is a cross-sectional view taken along line 8—8 of FIG. 1.

As an additional means for locking the lid to the container, a slot 50 that extends through end wall 3 is provided along the upper edge of end wall 3. An end flange engaging hook 51 is integrally molded with lid 12, depending in one piece from the lid peripheral edge portion or lid flange 13. End hook 51 is further molded with L shaped reinforcing ribs 52, as shown in FIG. 1. In FIG. 8, end hook 51 is shown projecting into slot 50, to engage beneath end flange 11, when the lid and container have been translated horizontally from the closed position into the locked position. In the preferred embodiment, as shown in FIG. 1, two slots are provided and two correpondingly aligned end flange engaging hooks 51 are provided.

To facilitate interlocking of the bottom of one container with the lid of another container when in the stacked position of FIG. 10, the lid and bottom are provided with telescopically interfitting structure. As mentioned above, the lid is provided with an inset and recessed mid portion 21. Similarly, the bottom is of substantially the same shape and smaller than the lid mid portion so that in the position of FIG. 10, the top container is being restrained from horizontal movement in any direction by lid wall 22. In a preferred embodiment, the side and end walls are molded with a taper of approximately 7 degrees. The bottom wall 6 of one container may be stacked within the recessed mid portion 21 of a lid covering a like container.

The interior of the container is provided with dividers 60 that extend between opposite side walls and opposite end walls of the container. For supporting the dividers generally perpendicularly to bottom wall 6, the dividers are provided with hook portions 61. These hook portions are received within pockets 62 that are integrally molded within the side and end walls of the container. Pockets 62 are provided with an interior portion that includes a terminated side wall portion 63 that provides an upwardly extending flange structure over which hook 61 can be supported. Opposed pairs of pockets 62 allow the dividers to extend generally perpendicularly between the side walls of the container and the end walls of the container. The upper edge of the dividers, 64, is of a general shape corresponding with the recessed mid portion 21 of the lid, including rib 44. Therefore, when the lid is assembled on the container and the lid is in the closed or locked position, the dividers are prevented from being shifted upwardly and being unhooked or removed from pockets 62.

The exterior portion of the pockets 62 provide a nesting stop surface 65 that limits the extent that one container will nest within a like container when the containers are generally empty and stacked such as in transportation or storage. A nested stack of containers, with the lids and dividers removed, can be seen in FIG. 9.

Gussets 66 are formed integrally with the lid peripheral edge portion. Gussets 66 extend downwardly and inwardly as can be seen in FIG. 4. The outer tapered edge of the gussets provides a cam surface which coacts with flange connecting side wall 40 to center the lid between the container side walls. A plurality of gussets 66 are spaced along the peripheral edge of the lid so that if the container side walls are warped inwardly the lid can still be assembled onto the container with little effort. Gussets 66 also serve to seal off a small opening, existing, when lid is locked onto tray to seal out dust, dirt, etc.

While a preferred embodiment including various details has been shown for purpose of illustrating the present invention, further embodiments, variations and modifications are possible in accordance with the broader aspects of the present invention, all as defined by the spirit and scope of the following claims.

What is claimed is:

1. A security storage box for papers of a similar size, such as checks, comprising:

a one-piece molded synthetic resin open-topped container having opposed generally parallel side walls, opposed generally parallel end walls, and a rectangular bottom wall integrally connected around its periphery with respective lowermost edges of said side and said end walls, with said side and said end walls being serially connected together in a closed alternate array along adjacent vertically extending edges;

the upper edge portions of said side and said end walls opposed to said bottom wall including integrally formed outwardly extending horizontal flanges connected together around substantially the entire upper periphery of said container to constitute side and end flanges, said side flanges having a plurality of through apertures;

a lid separate from said container and integrally molded from synthetic resin in one piece, said lid being of a size and a retangular shape to close the open top of said container, said lid having a peripheral edge portion being rectangular and having a flange overlying said container flange, said lid integrally being formed with a plurality of side flange engaging hooks depending in one piece from said peripheral edge portion in alignment with and to extend through said through apertures of said container;

said side flange engaging hooks and through apertures being of a size and shape so that in one relative position of said lid and container, said lid may be translated generally vertically from a disengaged position above said container to a closed position on said container with said side flange engaging hooks extending completely through said apertures and thereafter translated horizontally parallel to said side walls to engage said side flange engaging hooks beneath said container flanges to a locked position; and, a slot extending longitudinally between said side walls along the upper edge of one of said end walls, said lid integrally being formed with at least one end flange engaging hook depending in one piece from said peripheral edge portion of said lid in alignment with said slot of said container, said end flange engaging hook extending into said slot to engage beneath said end flange of said container when said lid is translated horizontally from said closed position to said locked position.

2. The box of claim 1, further including separate lock means to secure said lid and container against horizontal translation from said locked position to said closed position.

3. The box of claim 2, wherein said lock means includes said lid flange and said container flange in said locked position having at least one pair of aligned through apertures for receiving therethrough a security tie.

4. The box of claim 1, wherein said container peripheral edge portion is provided with a flange downwardly depending from the outer edges of said side wall flanges, parallel to respective side walls;

and including a plurality of webs extending between said vertical flanges and the adjacent container side walls;

and said through apertures extending into the space between said side walls and their adjacent vertical flanges between said webs.

5. The box of claim 1, wherein said lid includes a flat planar horizontal major mid-portion that is rectangular, inset with respect to the periphery of said lid and recessed with respect to said lid flange;

said lid further including vertically extending side and end walls integrally joining said recessed and inset lid mid-portion and said lid peripheral flange;

said container bottom is substantially the same shape and smaller than said lid mid-portion so that one container may be stacked upon the lid closing a second like container with said one container bottom wall resting on said lid mid-portion and said one container being restrained from horizontal movement in any direction by said lid side and end walls.

6. The box according to claim 1, wherein said container walls have a plurality of integrally molded outwardly protruding pockets, each said pocket having interior and exterior portions;

said exterior portions comprising nesting stop means for limiting the extent that one substantially empty said container nests within a like substantially empty container when said containers are stacked in a nested stack.

7. The box according to claim 6, further including dividers extending between said pockets, said dividers having opposed upper and lower edges and opposed side edges, said dividers further including means for engaging said pockets such that said dividers are supported substantially perpendicularly to said bottom wall.

8. The box according to claim 1, wherein said lid has an integrally molded, downwardly projecting rib extending continuously from said lid mid-portion adjacent the periphery of said lid mid-portion for reinforcing said lid mid-portion against warpage.

9. A storage box for papers of a similar size, such as checks comprising:

a one piece molded synthetic resin open topped container having opposed generally parallel side walls, opposed generally parallel end walls, and a rectangular bottom wall integrally connected around its entire periphery with respective lower most edges of said side and end walls, with said side and end walls being serially connected together in a closed alternate array along adjacent vertically extending edges;

a plurality of pockets molded integrally with said side and said end walls, said pockets protruding outwardly and having interior and exterior portions;

said exterior portions of said pockets comprising nesting stop means for limiting the extent that one said continer nests within a like container when said containers are stacked in a nested stack.

10. The box according to claim 9 further including:

dividers extending between said end walls and said side walls said dividers having opposed upper and lower edges and opposed side edge, said dividers having means for engaging said pockets such that said dividers are supported by said engaging means generally perpendicularly to said bottom wall.

11. The box according to claim 1, further including:

said side flanges of said container comprising upper and lower horizontal flanges integrally connected together by a flange connecting side wall of said container;

a flange connecting side wall cut out portion adjacent said through aperture and extending beyond the periphery of said through aperture in a direction toward said one of said end walls;

said side walls having a downwardly extending recessed portion aligned directly below said through aperture adjacent said flange connecting side wall and having a length equal to the length of said through aperture;

said side flange engaging hooks having a downwardly extending shaft portion, a horizontally extending return portion, said return portion being integrally connected with said lid mid-portion;

a first downwardly extending rib formed integrally with said lid mid-portion at the periphery of said lid mid-portion, a second downwardly extending rib spaced outwardly from said first rib and formed integrally with said return portion, said first and said second ribs being generally parallel to each other, a third downwardly extending rib formed integrally with and extending transversely between said first and said second ribs along said return portion at the end of said return portion that is adjacent said shaft portion;

said third rib being received within said recessed portion of said side walls and engaging the upper most edge of said side wall that forms the bottom of said recessed mid-portion of said side walls; and, said lower horizontal flange being received between said first and second ribs when said lid is translated horizontally from said disengaged position to said locked position.

12. The box according to claim 1 wherein said lid has a plurality of gussets formed integrally with said lid peripheral edge portion, said gussets extending downwardly and inwardly comprising cam surfaces coacting with said flange connecting side walls of said containers to center said lid between said container side walls.

* * * * *